US005542403A

United States Patent [19]

Borland et al.

[11] Patent Number: 5,542,403

[45] Date of Patent: Aug. 6, 1996

[54] METHOD OF DETERMINING START OF CLOSED-LOOP FUEL CONTROL FOR AN INTERNAL COMBUSTION ENGINE

[75] Inventors: Mark S. Borland, Birmingham; Bruce H. Teague, Grosse Pointe Park, both of Mich.

[73] Assignee: Chrysler Corporation, Highland Park, Mich.

[21] Appl. No.: 342,297

[22] Filed: Nov. 18, 1994

[51] Int. Cl.[6] ..... F02D 41/14

[52] U.S. Cl. ..... 123/686

[58] Field of Search ..... 123/686, 688, 123/689

[56] References Cited

U.S. PATENT DOCUMENTS

| | | | |
|---|---|---|---|
| 4,385,613 | 5/1983 | Yoshida et al. | 123/688 X |
| 4,399,792 | 8/1983 | Otsuka et al. | 123/686 |
| 4,930,480 | 6/1990 | Noyori | 123/686 |
| 5,003,944 | 4/1991 | Moote et al. | 123/299 |
| 5,003,952 | 4/1991 | Weglarz et al. | 123/478 |
| 5,003,953 | 4/1991 | Weglarz et al. | 123/478 |

*Primary Examiner*—Tony M. Argenbright
*Attorney, Agent, or Firm*—Mark P. Calcaterra

[57] ABSTRACT

A method of determining start of closed-loop fuel control for an internal combustion engine including the steps of determining a base fuel pulsewidth threshold, ascertaining whether a current accumulated base fuel pulsewidth is greater than or equal to the base fuel pulsewidth threshold, updating the current accumulated base fuel pulsewidth with a value of a previous accumulated base fuel pulsewidth plus the current base fuel pulsewidth if the current accumulated base fuel pulsewidth is not greater than or equal to the base fuel pulsewidth threshold, and beginning a closed loop fuel control of a plurality of fuel transferring components if the current accumulated base fuel pulsewidth is greater than or equal to the base fuel pulsewidth threshold.

10 Claims, 1 Drawing Sheet

METHOD OF DETERMINING START OF CLOSED-LOOP FUEL CONTROL FOR AN INTERNAL COMBUSTION ENGINE

BACKGROUND OF THE INVENTION

1. Field of the Invention

The present invention relates generally to fuel control for internal combustion engines and, more particularly, to a method of determining start of closed-loop fuel control for an internal combustion engine in an automotive vehicle.

2. Description of the Related Art

Typically, automotive vehicles include internal combustion engines having fuel control in accordance with engine control strategies. Many current engines operate without closed-loop fuel control for a variable amount of time after engine starting. For example, current engine control strategies rely on timers to delay operation of fuel control after engine starting to allow for sensor/component preconditioning. This time delay allows an oxygen ($O_2$) sensor time to heat up and reach an active state before it can operate reliably to aid in controlling fuel and air to the engine. Minimizing this time delay (within limits of system functionality) generally improves engine control and reduces exhaust emissions from the engine.

Generally, the time to reach an active state for the oxygen sensor varies based on what the vehicle does after engine start. If the vehicle sits at idle, relatively cool exhaust gases blow across the oxygen sensor and tend to cool it. If the vehicle is driven away, the exhaust gases are much hotter and will not cool but may even tend to heat the oxygen sensor. Since current engine control strategies allow a fixed time delay value to be chosen for the closed-loop fuel control transition, it must be calibrated for the worst case idle only condition. This time delay value could be better modeled and minimized by using a measurement of energy input to the engine. As a result, there is a need in the art to minimize the time delay before beginning closed-loop fuel control for the engine that is uniquely adapted to the actual operating conditions after each engine start.

SUMMARY OF THE INVENTION

It is, therefore, one object of the present invention to provide a method of determining start of closed-loop fuel control for an internal combustion engine.

It is another object of the present invention to provide a method of determining start of closed-loop fuel control for an internal combustion engine using an accumulated base fuel pulsewidth as an energy input gage.

To achieve the foregoing objects, the present invention is a method of determining start of closed-loop fuel control for an internal combustion engine including the steps of determining a base fuel pulsewidth threshold and ascertaining whether a current accumulated base fuel pulsewidth is greater than or equal to the base fuel pulsewidth threshold. The method also includes the steps of updating the current accumulated base fuel pulsewidth with the value of a previous accumulated base fuel pulsewidth plus a current base fuel pulsewidth if the current accumulated base fuel pulsewidth is not greater than or equal to the base fuel pulsewidth threshold, and beginning a closed loop fuel control of a plurality of fuel transferring components for the engine if the current accumulated base fuel pulsewidth is greater than or equal to the base fuel pulsewidth threshold.

One advantage of the present invention is that a method is provided for determining start of closed-loop fuel control for an internal combustion engine. Another advantage of the present invention is that the method uses the accumulated base fuel pulsewidth as the energy input to enable a minimal time delay before beginning closed-loop fuel control for the engine that is uniquely adapted to the actual operating conditions of the engine after each start. Yet another advantage of the present invention is that the method provides a calibratable way for optimizing the closed loop fuel control transition time after each start of the engine.

Other objects, features and advantages of the present invention will be readily appreciated as the same becomes better understood after reading the subsequent description when considered in conjunction with the accompanying drawings.

DESCRIPTION OF THE PREFERRED EMBODIMENT(S)

Figure 1:
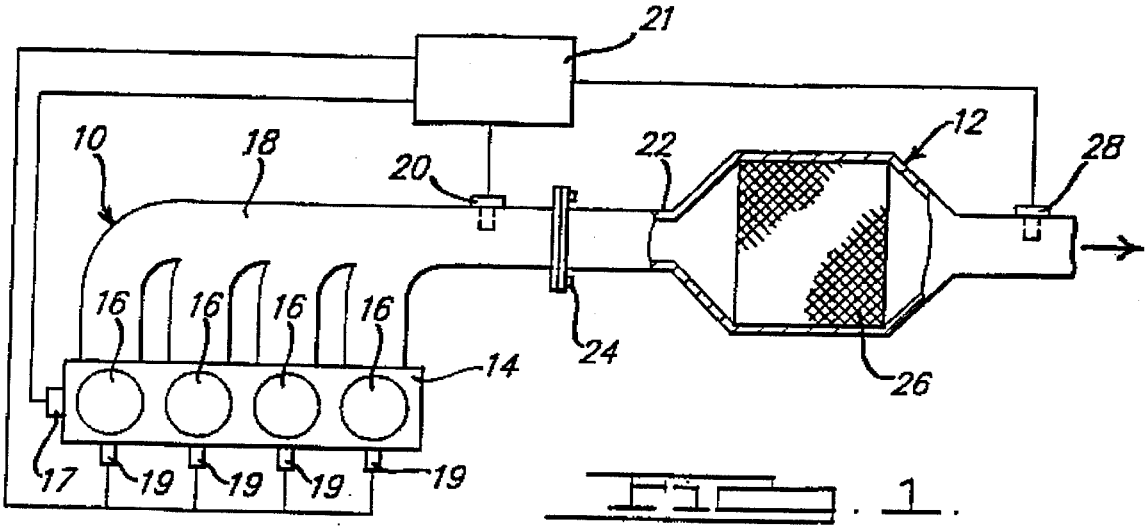
FIG. 1 is a fragmentary plan view of an internal combustion engine and exhaust system for an automotive vehicle.

Referring to FIG. 1, an internal combustion engine, generally indicated at 10, and an exhaust system, generally indicated at 12, are shown for a vehicle such as an automotive vehicle (not shown). The engine 10 has an engine block 14 with a plurality of cylinders 16 for combustion of fuel and air to the engine 10. The engine 10 includes an engine coolant temperature sensor 17 connected to the engine block 14 for sensing a temperature of the liquid coolant for the engine 10 as is known in the art. The engine 10 also includes an exhaust manifold 18 connected to the cylinders 16 and the exhaust system 12. The exhaust manifold 18 provides at least one exhaust passageway for the exhaust gases from the cylinders 16. The engine 10 includes a plurality of fuel transferring components or injectors 19 for metering fuel to the cylinders 16 as is known in the art. The engine 10 further includes a first or front oxygen sensor 20 to sense the amount of oxygen in exhaust gases from the cylinders 16 as is known in the art. An engine control unit 21 is connected to the front oxygen sensor 20 and coolant temperature sensor 17. It should be appreciated that the engine control unit 21 has a microprocessor and memory as is known in the art for receiving signals from the coolant temperature sensor 17 and front oxygen sensor 20 for controlling fuel and air to the cylinders 16 of the engine 10.

The exhaust system 12 has a catalytic converter 22 connected to the exhaust manifold 18 by suitable connectors such as fasteners 24 for receiving the exhaust gases. The catalytic converter 22 also has a catalyst substrate 26 disposed therein for converting the exhaust gases into by-products as is known in the art. The exhaust system 12 includes a second or rear oxygen sensor 28 connected to the engine control unit 21 to sense the amount of oxygen in the exhaust gases exiting the catalytic converter 22. It should be appreciated that the rear oxygen sensor 28 provides signals to the engine control unit 21 for controlling fuel and air to the cylinders 16 of the engine 10.

Figure 2:
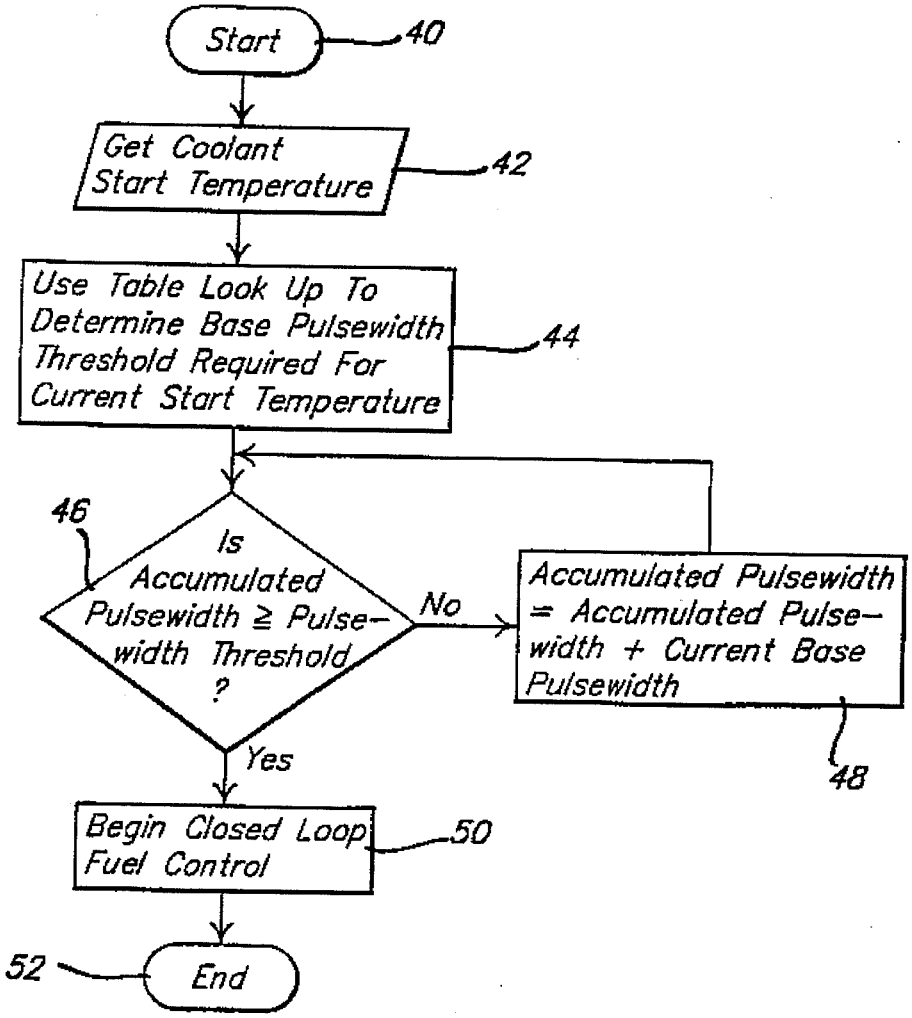
FIG. 2 is a flowchart of a method of determining start of closed-loop fuel control for the internal combustion engine of FIG. 1.

Referring to FIG. 2, one embodiment of a method of determining start of closed-loop fuel control for the engine 10 is shown. The methodology starts in bubble 40 and advances to block 42 to obtain or get a coolant start temperature from the coolant temperature sensor 17. The engine control unit 21 receives a signal from the coolant temperature sensor 17 after start of the engine 10 which is indicative of the temperature of the liquid coolant for the engine 10. After block 42, the methodology advances to block 44 and uses a look-up table stored in memory of the engine control unit 21 to determine a base fuel pulsewidth threshold required for the current or read coolant start temperature. The look-up table is an empirically derived table of coolant start temperatures versus accumulated base fuel pulsewidths after start of engine. The accumulated base fuel pulsewidth is a sum of base fuel pulsewidths. The base fuel pulsewidth is a portion of a signal sent by the engine control unit 21 to the fuel injectors 19 to meter a predetermined amount of fuel to the cylinders 16. It should be appreciated that the base fuel pulsewidth is a value empirically derived from values of engine speed and air pressure stored in memory of the engine control unit 21 and lacks enrichments for other engine operating conditions.

After block 44, the methodology advances to diamond 46 and determines whether the accumulated base fuel pulsewidth is greater than or equal to the base fuel pulsewidth threshold. If not, the methodology advances to block 48 and sets the accumulated base fuel pulsewidth equal to the accumulated base fuel pulsewidth plus the current base fuel pulsewidth. After block 48, the methodology returns to diamond 46 previously described. It should be appreciated that the accumulated base fuel pulsewidth is initially set at zero (0).

In diamond 46, if the accumulated base fuel pulsewidth is greater than or equal to the base fuel pulsewidth threshold, the methodology advances to block 50 and begins closed loop fuel control for the engine 10 as is known in the art. The engine control unit 21 sends signals to the fuel injectors 19 of the engine 10 to meter a predetermined amount of fuel to the cylinders 16. After block 50, the methodology advances to bubble 52 and ends the routine. It should be appreciated that such closed-loop fuel control is known in the art.

Accordingly, the method determines the start of closed loop fuel control for the engine 10. The method enables the engine 10 to get to closed loop fuel control faster to lower emissions and/or to maintain good driveability with greater confidence that the oxygen sensors are operating correctly.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of determining start of closed-loop fuel control for an internal combustion engine having a plurality of fuel transferring components, at least one exhaust passageway, and at least one oxygen sensor disposed within the exhaust passageway, the method comprising the steps of:

determining a base fuel pulsewidth threshold;

ascertaining whether a current accumulated base fuel pulsewidth is greater than or equal to the base fuel pulsewidth threshold;

updating the current accumulated base fuel pulsewidth with a value of a previous accumulated base fuel pulsewidth plus a current base fuel pulsewidth if the current accumulated base fuel pulsewidth is not greater than or equal to the base fuel pulsewidth threshold; and beginning a closed loop fuel control of the plurality of fuel transferring components if the current accumulated base fuel pulsewidth is greater than or equal to the base fuel pulsewidth threshold.

2. A method as set forth in claim 1 including the step of sensing a temperature of the engine prior to said step of determining.

3. A method as set forth in claim 1 including the step of sensing a coolant temperature of the engine prior to said step of determining.

4. A method as set forth in claim 1 including the step of returning to said step of ascertaining after said step of updating the current accumulated base fuel pulsewidth.

5. A method as set forth in claim 1 including the step of disposing at least one oxygen sensor upstream of a catalyst connected to the exhaust passageway prior to said step of determining.

6. A method as set forth in claim 5 including the step of disposing at least one oxygen sensor downstream of the catalyst prior to said step of determining.

7. A method as set forth in claim 3 wherein said step of determining comprises using a look-up table to determine a base fuel pulsewidth threshold based on the read coolant temperature of the engine.

8. In an engine and associated control system methodology, the engine including a plurality of fuel transferring components, at least one exhaust passageway, a catalyst disposed in the at least one exhaust passageway, and at least one oxygen sensor disposed within the at least one exhaust passageway, the method comprising the steps of:

sensing a coolant start temperature;

determining a base fuel pulsewidth threshold required for the coolant start temperature;

ascertaining whether a current accumulated base fuel pulsewidth is greater than or equal to the base fuel pulsewidth threshold;

updating a current accumulated base fuel pulsewidth with a value of a previous accumulated base fuel pulsewidth plus a current base fuel pulsewidth if the current accumulated base fuel pulsewidth is not greater than or equal to the base fuel pulsewidth threshold;

returning to ascertain whether the current accumulated base fuel pulsewidth is greater than or equal to the base fuel pulsewidth threshold after updating the current accumulated base fuel pulsewidth;

beginning a closed loop control of the plurality of fuel transferring components; and returning to perform another engine control tasks.

9. A method as set forth in claim 8 including the step of disposing at least one oxygen sensor upstream of the catalyst.

10. The method as set forth in claim 8 including the step of disposing at least one oxygen sensor downstream of the catalyst.

* * * * *